US005865257A

United States Patent [19]

Kozyrev et al.

[11] Patent Number: 5,865,257

[45] Date of Patent: Feb. 2, 1999

[54] METHOD AND APPARATUS FOR EXTINGUISHING FIRES IN ENCLOSED SPACES

[75] Inventors: Valeriy Nikolaevitch Kozyrev, Moscow; Valeriy Nilovitch Yemelyanov; Alexey Ivanovitch Sidorov, both of Moskovskaya oblast'; Vladimir Andreevitch Andreev, Moscow, all of Russian Federation

[73] Assignee: R-Amtech International, Inc., Bellevue, Wash.

[21] Appl. No.: 841,143

[22] Filed: Apr. 24, 1997

[30] Foreign Application Priority Data

| | | | |
|---|---|---|---|
| Apr. 30, 1996 | [RU] | Russian Federation | 96108058 |
| Apr. 30, 1996 | [RU] | Russian Federation | 96108059 |
| Apr. 30, 1996 | [RU] | Russian Federation | 96108060 |

[51] Int. Cl.[6] ..... A62C 2/00

[52] U.S. Cl. ..... 169/46; 169/12; 169/54; 169/62

[58] Field of Search ..... 169/11, 12, 46, 169/54, 62, 84; 239/13, 128

[56] References Cited

U.S. PATENT DOCUMENTS

| | | | |
|---|---|---|---|
| 283,996 | 8/1883 | Garfield | 169/12 |
| 633,807 | 9/1899 | Clayton | 169/12 |
| 702,714 | 6/1902 | Febiger | 169/12 X |
| 5,423,384 | 6/1995 | Galbraith et al. | 169/12 |
| 5,425,426 | 6/1995 | Baratov et al. | 169/12 X |
| 5,441,114 | 8/1995 | Spector et al. | 169/14 |

FOREIGN PATENT DOCUMENTS

| | | |
|---|---|---|
| 0561035A1 | 9/1993 | European Pat. Off. . |
| 0578843A1 | 1/1994 | European Pat. Off. . |
| 0637458A1 | 2/1995 | European Pat. Off. . |
| 2060743 | 4/1994 | Russian Federation . |
| 1764213 | 5/1988 | U.S.S.R. . |
| 1821985 | 10/1988 | U.S.S.R. . |
| 2020971 | 11/1979 | United Kingdom . |
| 9217244 | 10/1992 | WIPO . |
| 9423800 | 10/1994 | WIPO . |

OTHER PUBLICATIONS

A.N. Baratov, Ye.N. Ivanov: Fire Extinguishing In chemical and Oil Refining Industry; Moscow, Izdatelstvo Khimija, 1979.

*Primary Examiner*—Andres Kashinikow
*Assistant Examiner*—Steven J. Ganey
*Attorney, Agent, or Firm*—Rothwell, Figg, Ernst & Kurz, p.c.

[57] ABSTRACT

In the method for extinguishing fires in enclosed spaces, pre-cooled combustion products are introduced into an enclosed space until in the enclosed space there is an atmosphere that prevents combustion. An ecologically acceptable and fire-inhibiting medium that is not detrimental to health is formed by oxidizing the combustion products completely by an oxygen-containing oxidizing agent prior to cooling. An apparatus for implementing the method has a housing (1) which is divided by a transversely running partition wall (11) having at least one wall opening (15). At the at least one wall opening (15) a mixing tube (8) is mounted coaxially with respect to a discharge nozzle (2) connected to a combustion chamber (14), the end of the mixing tube remote from the partition wall (11) opening into the atmosphere. The space (7) between the mixing tube (8) and the inner wall of the housing (1) is filled with a coolant. Inlet openings (9) are formed in the wall of the housing (1) between the partition wall (11) and the end face of the combustion chamber (14) facing the partition wall (11). The discharge nozzle (2) is in the form of a jet pipe (6) and extends through the wall opening (15) into the mixing tube (8), a gap being present between the jet pipe (6) and the mixing tube (8).

6 Claims, 1 Drawing Sheet

METHOD AND APPARATUS FOR EXTINGUISHING FIRES IN ENCLOSED SPACES

FIELD OF THE INVENTION

The invention is concerned with fire-extinguishing technology, in particular the prevention and extinguishing of fires in enclosed spaces.

DESCRIPTION OF THE BACKGROUND ART

To extinguish a fire in an enclosed space it is known to create in the enclosed space an atmosphere which prevents combustion. Inert solvents (carbon dioxide, nitrogen, argon, water vapour), volatile inhibitors, halogenated agents or extinguishing powders (A. N. Baratov, E. M. Ivanov "Extinguishing fires in the chemical and oil-refining industries", Moscow, Chemistry, 1979) are used as fire extinguishing agents.

The known fire extinguishing systems for fires in enclosed spaces cannot be used, however, for extinguishing alkali-metals and alkaline earth metals and some metal hydrides and metal compounds which contain oxygen in their molecules.

The construction of fire extinguishing systems for rooms in very large buildings is difficult, because an adequate amount of gas has to be made available in a certain time. In addition, because of the danger of suffocation, signalling systems that indicate the implementation of the extinguishing process are necessary.

The use of halogenated compounds to extinguish fire likewise has a number of drawbacks. The effect of these agents on humans can be toxic, since their thermal decomposition when extinguishing fire gives rise to products having a highly corrosive action.

In addition, enclosed spaces at particular risk from fire are normally protected by very large fire-extinguishing systems employing halogenated hydrocarbons. On account of international measures for protection of the ozone layer in accordance with the Montreal protocol (1987), fluorohydrocarbons need to be reduced by half by 1995 and to be eliminated completely by the year 2000, since the potential of these substances to destroy ozone is high.

Fire-extinguishing systems having devices to produce fluorocarbon compounds are already known, for example from GB-PS 2 020 971. The disadvantage of these systems is the damaging effect of the fluorocarbon compounds on the environment. In addition, these systems have fairly large dimensions and are fairly heavy, so that they cannot be used very effectively to extinguish fires in means of transportation, for example, in air traffic.

GB-PS 2 028 127 discloses a fire extinguishing device having a housing with a discharge opening, a charge for producing the fire-extinguishing substance, and an ignition unit. When the ignition unit is operated, the pyrotechnic or solid-fuel charge is ignited, and the gaseous combustion products thereof form the fire extinguishing substance that passes through the discharge opening into the fire region and extinguishes the fire. The effectiveness of this apparatus is unsatisfactory, however, since the capacity of the gaseous combustion products, which are inert solvents, to extinguish fire is slight.

PCT/RU 92/00071 discloses a method for producing a fire-extinguishing mixture in which a mixture of solid particles and inert gases is produced on letting off the charge comprising a pyrotechnic composition. The high dispersion degree of these particles, their chemical property and the freshly formed surface ensure a substantial fire-extinguishing action.

That method has a number of drawbacks, however. The high temperature of the combustion products leads to an increase in the average temperature in the enclosed space to be protected, which has an adverse effect on living things in this enclosed space and on valuables (for example, documents, paintings etc.). As the aerosol cools, the proportion of unreacted elements in the combustion products, and consequently also the proportion of NH3, CO, nitrogen oxide and other products in the fire-extinguishing agent, increases dramatically. In addition, on combustion of the pyrotechnic, solid-fuel, aerosol-forming fire-extinguishing mixture compositions and ballistic compositions, in addition to the primary gaseous aerosol products having the extinguishing action, gaseous products of the incomplete combustion of organic components (NH3, H2, CHx) and nitrogen oxides (NOx) are also released, which leads to pollution of the environment by these products.

SUMMARY OF THE INVENTION

The invention is based on the problem of developing a method and an apparatus for extinguishing fires in enclosed spaces by which an ecologically acceptable and fire-prevention medium that is not detrimental to health can be formed and introduced into the enclosed space to be protected.

That problem is solved by a method and by an apparatus according to the invention.

With the method according to the invention and the apparatus according to the invention, extinguishing is effected by the inhibiting action of the condensed aerosol phase on the flames. The aerosol phase is formed on combustion of the solid fuel after ignition of a charge consisting of a pyrotechnic composition, the combustion products first being re-combusted by means of the oxygen-containing oxidizing agent, for example, air, and then being cooled to the required temperature.

Re-combustion of the products of incomplete combustion to full oxidation thereof by the atmospheric oxygen (2CO+O2−2CO2; 2NH3+1.5O2−N2+3 H2O; 2H2+O2−2H2O; CHx+02−C02+H2O) and neutralisation of the nitrogen oxides (NOx+CO−N2+CO2; NOx+NH3−N2+H2O; NOx+H2−N2+H2O; NOx+CHx−N2+H2O+CO2) is effected preferably in an ejector jet.

By re-combustion and subsequent cooling of the combustion products of the aerosol-forming fire-extinguishing compositions, the effectiveness of the fire-extinguishing aerosol and operational safety can be increased, since the combustion products contain no highly dangerous gases.

BRIEF DESCRIPTION OF THE DRAWING

The sole FIGURE is an elevational view in longitudinal section of an apparatus in accordance with the present invention.

DETAILED DESCRIPTION OF THE PREFERRED EMBODIMENTS

Figure 1:
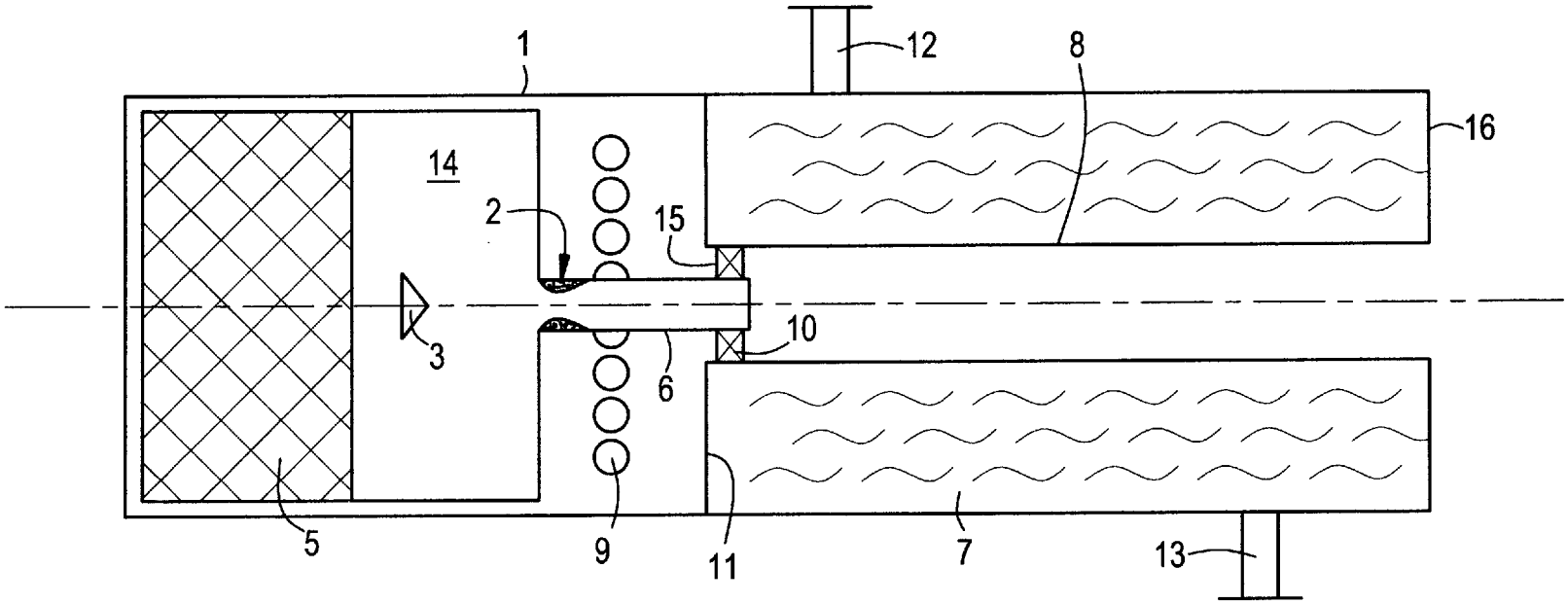

An exemplary embodiment of the invention is explained in further detail with reference to the accompanying drawing, which shows a longitudinal section through an apparatus for extinguishing fires in enclosed spaces. The apparatus for extinguishing fires in enclosed spaces consists of a cylindrical housing 1 in which a combustion chamber 14 is formed adjacent to one end face. At the end face end of the combustion chamber 14 there is arranged a charge 5 comprising a solid fuel, this charge being, for example, an aerosol-forming agent which contains a nitrate of an alkaline earth metal, an organic combustible bonding agent and an aerosol gas generator; the aerosol-forming agent contains potassium nitrate having a specific metallic surface of not less than 1500 cm2/g as the alkaline earth metal, phenol formaldehyde resin having a mean particle diameter of not more than 100 micrometres as combustible bonding agent, and dicyanodiamide having a particle size of not more than 15 micrometres as aerosol gas generator.

The constituents are preferably present in the following ratio in mass %:

potassium nitrate 67–72 phenol formaldehyde resin 8–12 dicyanodiamide, remainder.

In the combustion chamber 14 there is also an ignition unit 3 for igniting the charge 5. A discharge nozzle 2 in the form of a Venturi nozzle is centrally arranged at the end of the combustion chamber 14 remote from the charge 5 and opens into the combustion chamber 14 and has a section of jet pipe 6 after the constriction.

In the outer wall of the housing 1 at the level of the section of jet pipe 6 there are provided inlet openings 9 for the admission of air to the section of jet pipe 6.

At a distance from the combustion chamber 14 a partition wall 11 is arranged transversely to the longitudinal direction of the housing 1. In the partition wall 11 there is a central wall opening 15, from which a mixing tube 8 extends coaxially with respect to the housing 1 as far as the other end face 16 of the housing 1 and opens into the open air.

The jet tube section 6 extends with its free end through the opening 15 coaxially into the mixing tube 8. In the annular slot between the jet pipe section 6 and the mixing tube 8 there is arranged a swirling device 10.

The annular cooling chamber 7 between the mixing tube 8, the partition wall 11, the other end face 16 and the wall of the housing 1 is closed. An inlet nozzle 12 and a discharge nozzle 13, which are connected to the annular cooling chamber 7, are provided on the wall of the housing 1.

The cooling chamber is connected by way of the inlet nozzle 12 and the discharge nozzle 13 to a cooling system, for example, of a motor vehicle or a ship's engine, and is filled with a coolant.

To extinguish a fire, the ignition device 3 is triggered, consequently igniting the charge 5. The resulting combustion products leave the combustion chamber 14 by virtue of the explosion pressure via the discharge nozzle 2 and the jet tube section 6, and at the free end of the jet tube section 6 are blown into the air present in the mixing tube 8 and mix with this air.

In the mixing tube 8 the combustion products are re-combusted by means of the air to complete oxidation thereof, and are subsequently cooled to the required temperature.

In the fire extinguishing apparatus described, only one mixing tube 8 is provided. Depending on the requirements made of the exit temperature of the aerosol and the length of the aerosol jet, however, several mixing chambers 8 can be provided parallel to one another, into each of which extends a jet tube section 6 of a discharge nozzle 2 that is connected to the combustion chamber 14. A large jet is consequently divided into several narrower jets, with the result that improved cooling and improved mixing with air and consequently a more effective re-combustion of the unreacted combustion products is achieved. The non-contact cooling of the aerosol precludes "contamination" of the aerosol by the decomposition products of the coolant, and is therefore extremely environmentally friendly.

Atmospheric air or any other gaseous oxidant can be used as oxidising agent.

To improve the supply of air and to lengthen the aerosol jet, the air can be supplied under pressure. Nevertheless, operation without elevated pressure is also possible.

We claim:

1. Method for extinguishing fires in enclosed spaces, wherein combustion products are completely oxidized by means of an oxygen-containing oxidizing agent, said completely oxidized combustion products are cooled by a coolant without having contact with said coolant, and said completely oxidized and cooled combustion products are introduced into an enclosed space until in said enclosed space there is an atmosphere that prevents combustion.

2. Method according to claim 1, wherein atmospheric air is used as the oxygen-containing oxidizing agent.

3. Apparatus for extinguishing fires in enclosed spaces, comprising a housing having a housing wall and being divided by a transversely running partition wall having at least one partition wall opening, a combustion chamber arranged in said housing, a solid fuel aerosol-forming charge being arranged in said combustion chamber, an ignition device for igniting said charge, and at least one discharge nozzle which is connected to said combustion chamber, wherein at said at least one partition wall opening a mixing tube is mounted coaxially with respect to said discharge nozzle such that an enclosed space is formed between said mixing tube and said housing wall, said enclosed space being filled with a coolant and said mixing tube opening with an end thereof remote from said partition wall into an atmosphere, said discharge nozzle is a jet pipe and extends through said wall opening into said mixing tube, a gap being provided between said jet pipe and said mixing tube, air inlet openings are formed in said housing wall between said partition wall and an end face of said combustion chamber facing said partition wall for inletting air to an area of said housing around said jet pipe.

4. Apparatus according to claim 3, wherein a swirling device is arranged in said gap between said jet pipe and said mixing tube.

5. Apparatus according to claim 4, wherein a coolant inlet nozzle and a coolant outlet nozzle are connected to said enclosed space filled with said coolant.

6. Apparatus according to claim 3, wherein an inlet nozzle and an outlet nozzle are connected to said enclosed space filled with said coolant.

* * * * *